US010568368B2

(12) United States Patent
Clarke

(10) Patent No.: US 10,568,368 B2
(45) Date of Patent: Feb. 25, 2020

(54) METHOD FOR CONVERTING A SLEEVELESS DRESS TO ONE HAVING SLEEVES

(71) Applicant: DeAnna Clarke, Los Angeles, CA (US)

(72) Inventor: DeAnna Clarke, Los Angeles, CA (US)

( * ) Notice: Subject to any disclaimer, the term of this patent is extended or adjusted under 35 U.S.C. 154(b) by 0 days.

(21) Appl. No.: 16/037,330

(22) Filed: Jul. 17, 2018

(65) Prior Publication Data

US 2020/0022422 A1 Jan. 23, 2020

(51) Int. Cl.
*A41C 3/08* (2006.01)
*A41D 15/00* (2006.01)
*A41D 1/18* (2006.01)

(52) U.S. Cl.
CPC ..... *A41C 3/08* (2013.01); *A41D 1/18* (2013.01); *A41D 15/00* (2013.01)

(58) Field of Classification Search
CPC ..... A41D 1/18; A41D 15/00; A41D 15/002; A41D 15/007; A41D 27/14; A41D 27/136; A41C 3/08
USPC ..... 2/54, 56, 59, 305, 338, 340, 271, 105, 2/106; 450/86
See application file for complete search history.

(56) References Cited

U.S. PATENT DOCUMENTS 6,298,485 B1 * 10/2001 Heller ..... A41D 3/005 2/126
2004/0098783 A1 * 5/2004 Parson ..... A41D 27/136 2/54
2006/0089081 A1 * 4/2006 Peay ..... A41C 3/08 450/1
2011/0307992 A1 * 12/2011 Martinson ..... A41D 15/00 2/69
2015/0033451 A1 * 2/2015 Bradshaw ..... A41D 15/00 2/243.1
2015/0201686 A1 * 7/2015 Gauthier ..... A41D 15/00 2/69
2015/0272240 A1 * 10/2015 Smith ..... A41D 15/00 2/69
2018/0242660 A1 * 8/2018 Giangeruso ..... A41D 15/002

* cited by examiner

*Primary Examiner* — Gloria M Hale
(74) *Attorney, Agent, or Firm* — Irving Keschner

(57) ABSTRACT

A method for removably attaching a clothing item to a sleeveless dress. The dress wearer has an undergarment with straps. One end of a fastener is coupled to the one end of the, clothing item, the other end of the fastener being coupled to the item strap. The wearer has the option of replacing the clothing item with a different item by removing the fastener end from the strap and the original clothing item.

4 Claims, 5 Drawing Sheets

METHOD FOR CONVERTING A SLEEVELESS DRESS TO ONE HAVING SLEEVES

BACKGROUND OF THE INVENTION

1. Field of the Invention

The present provides a method for enabling a woman to connect a sleeveless blouse to a one having a sleeve by attaching one end to the sleeve to a brassiere strap.

2. Description of the Prior Art

Previous attempts have been made to attach a decorative sleeve to a woman's sleeveless blouse. One technique is to use a zipper to attach one end of the blouse to the edge of the blouse. However, this is an unattractive way of doing so.

Another way is disclosed in U.S. Pat. No. 6,868,555 to Zic et al. In this patent a new device is provided that has a center connection part and a plurality of extensions, each with one end connected to the center connection part and with another end connected to an attachment structure. One or more first extensions of the device are attached to one or more first locations of a clothing item and attaching one or more second extensions to one or more second locations of the clothing item to convert the clothing from one style to another style, or to decorate the clothing.

The device disclosed by Zic et al is relatively expensive and unattractive.

What is desired is to provide a simple and inexpensive technique for attaching clothing items, such as sleeves, of various designs to a woman's sleeveless blouse or dress.

SUMMARY OF THE PRESENT INVENTION

The present invention provides a method for attaching clothing items, such as sleeves, of different styles to a woman's sleeveless blouse or dress. A first end of a fastener is removable connected to one end of the clothing item, the second fastener end being connected to a brassiere strap located beneath the clothing item. The user can easily change to a different clothing item by removing the first end of the fastener from the original clothing item and the second end from the brassiere strap.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

The present invention provides a simple way for a woman to attach clothing items of various styles to a sleeveless dress or blouse.

Figure 1:
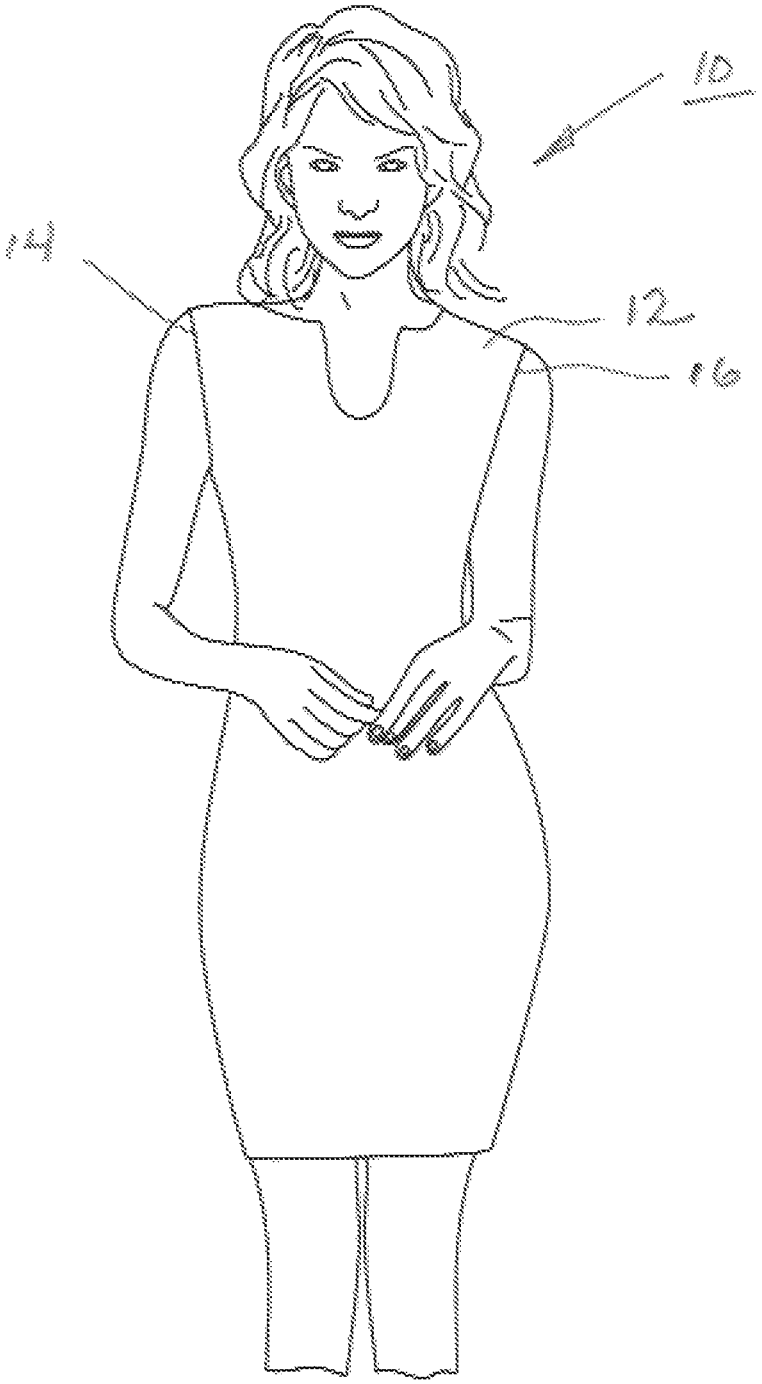
FIG. 1 is a view showing, in illustrative form, a woman wearing a sleeveless dress.

Referring to FIG. 1, a woman 10 is shown wearing a sleeveless dress 12. In accordance with the teachings of the present invention, a woman can attach clothing items, such as sleeves, of a specific design to both (or one) arm area 14 and/or 16 of dress 12.

Figure 2:
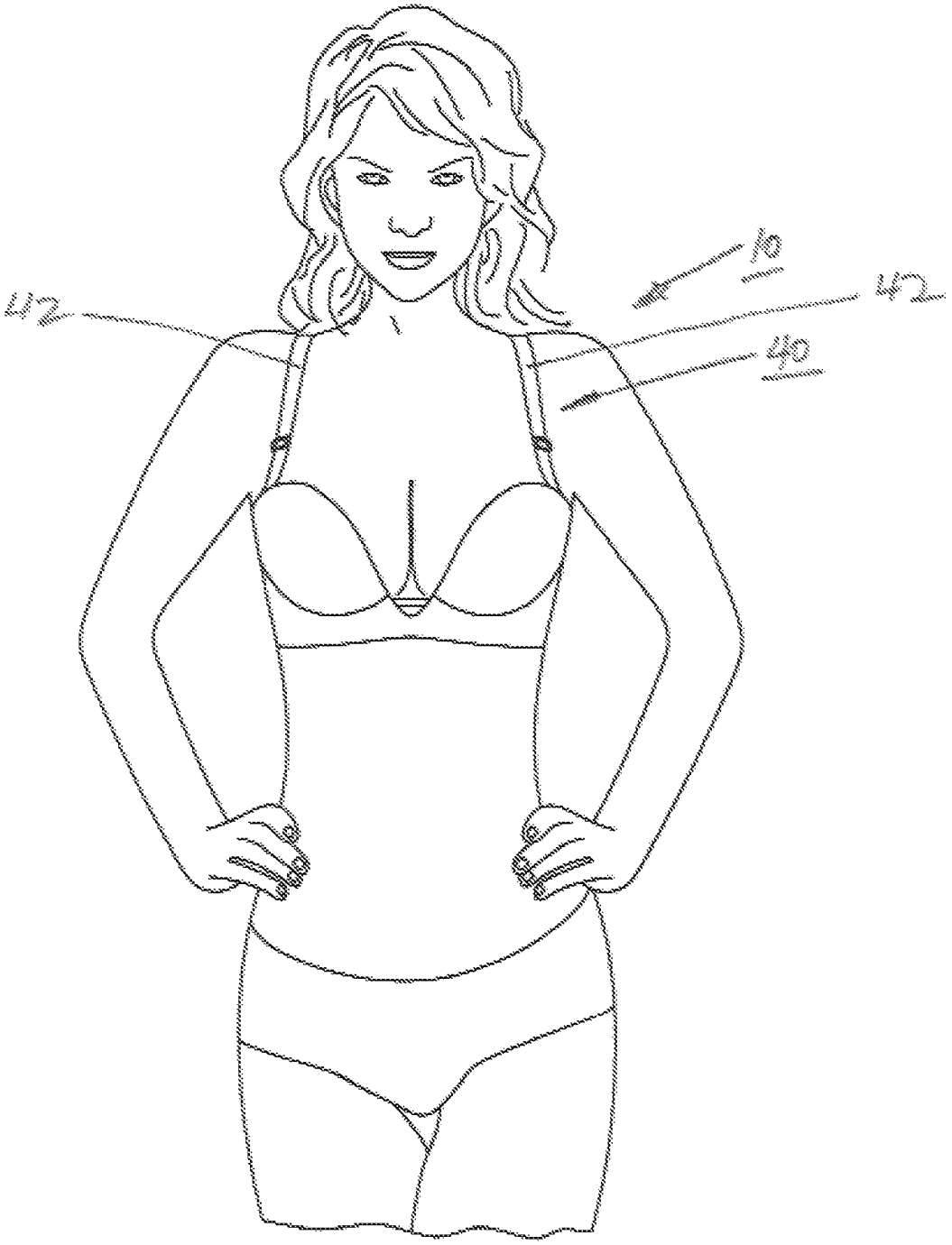
FIG. 2 shows a typical brassiere on the torso of the woman shown in FIG. 1.

FIG. 2 illustrates dress 12 removed from woman 10, exposing her undergarments, such as brassiere 40, brassiere 40 including straps 42.

Figure 3:
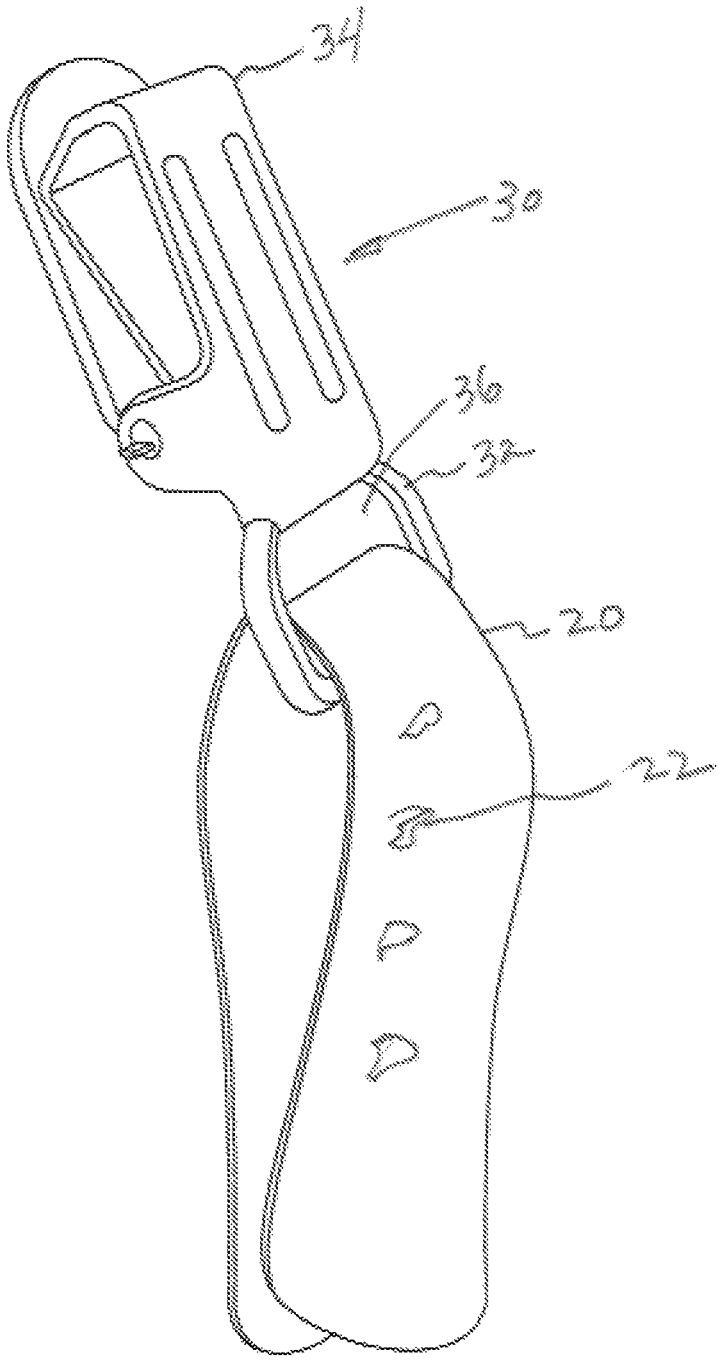
FIG. 3 shows a fastener that has been successfully utilized in the present invention.
Figure 5:
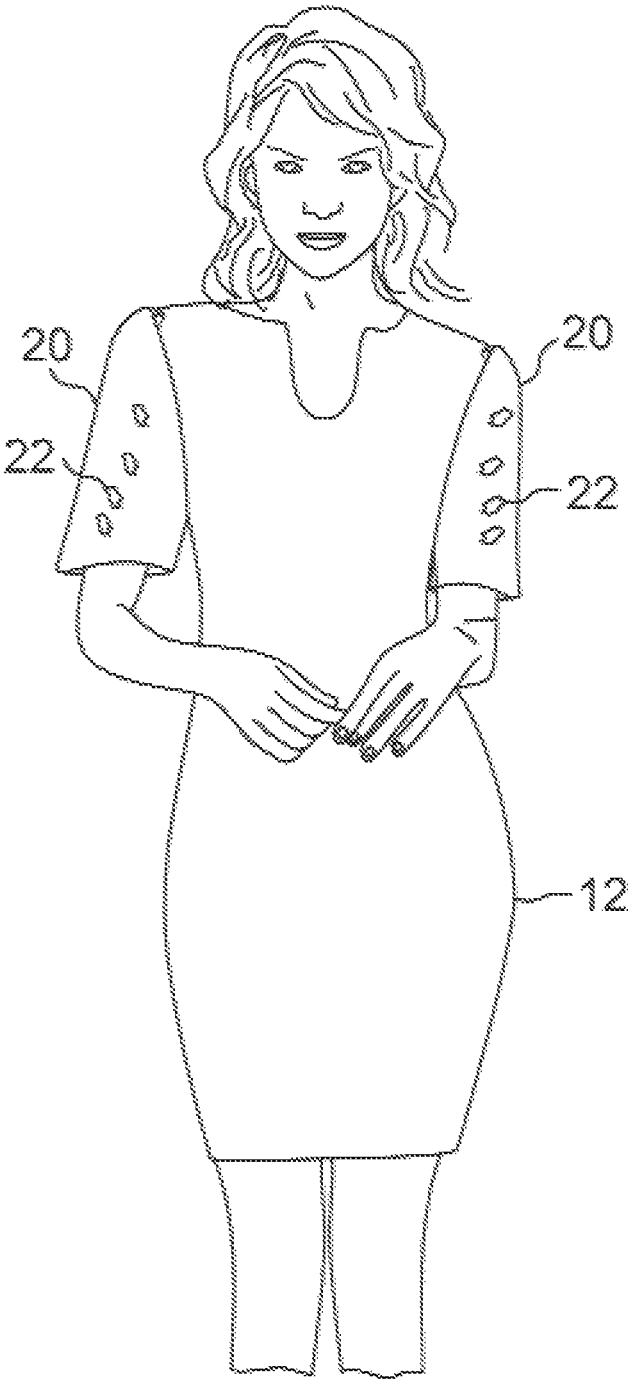
FIG. 5 shows the fastener having one end connected to the brassiere strap and the other end connected to a sleeve chosen by the wearer.

As shown in FIG. 5, clothing items 20 have a design 22 printed thereon is attached to the dress 12. In order to do so, a fastener 30, such as the one shown in FIG. 3, is provided, the fastener 30 comprising a hook portion 32 and a clip portion 34. Clothing item 20 is essentially an elongated material, such as silk, in a free-flowing shape that can be passed through opening 36 formed in hook 32 and secured thereto, for example, by a knot (not illustrated).

Figure 4:
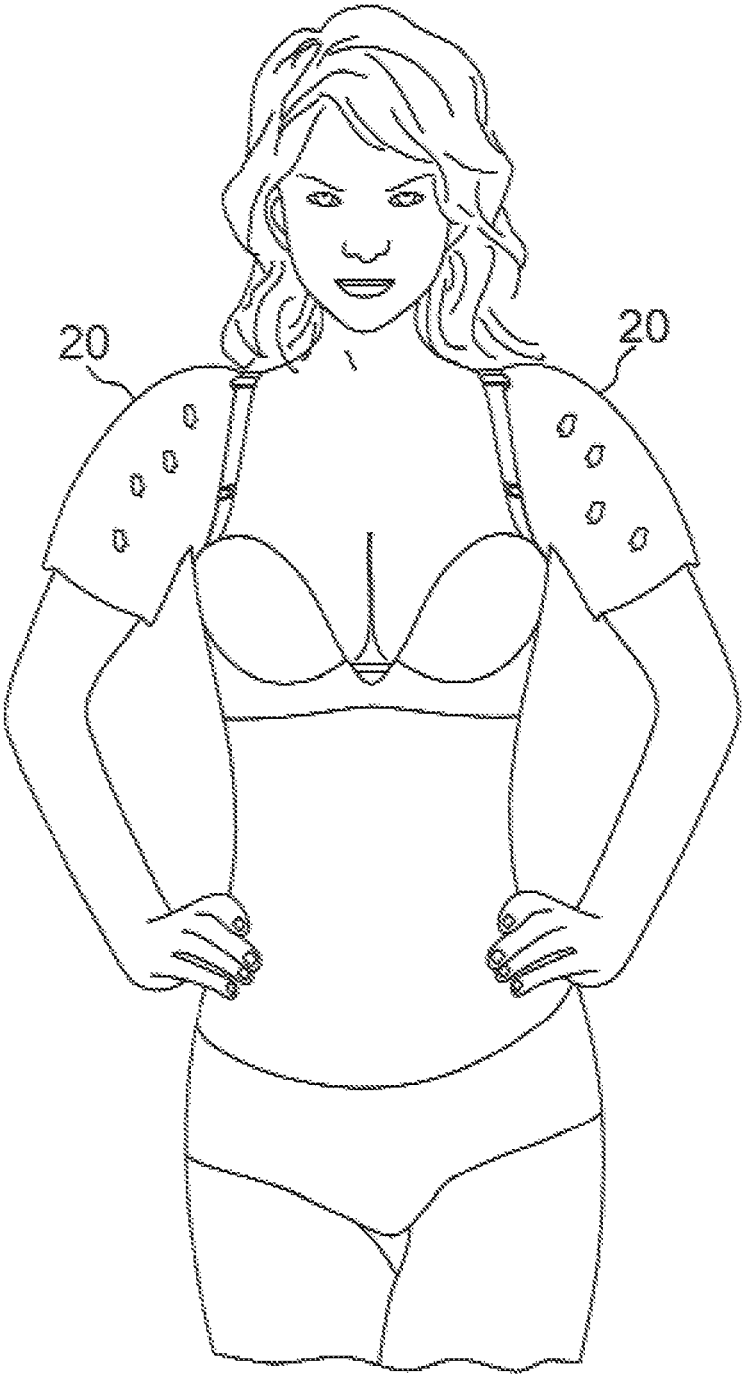
FIG. 4 shows a woman with a clothing item attached to the dress shown in FIG. 1.

As shown in FIG. 4, once the attachment of clothing item 20 to the strap 42 is completed, dress 12 is put back on, such that the brassiere strap 42, with clip portion 34 thereon, is not visible to others. Note that the dress 12 need not be removed, clip portion 34 being positioned under dress 12 and onto the brassiere strap 42 while dress 12 is being worn.

To remove clothing item 20, the wearer opens clip end 22 from strap 42, the item then being pulled away from dress 12. The wearer can then decide whether to replace the item 20 with a different item or leave the dress as shown in FIG. 1.

Note that different types of fasteners that are capable of attaching the clothing item to brassier strap 42 can be used. The fastener that has been successfully utilized and described above is the Sodial®, a webbing hook pacifier suspender clip manufactured by Shenzhen IMC Digital Technology Co. Ltd, Shenzhen, China.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A method of removably attaching a first clothing item having first and second ends to an undergarment worn below a sleeveless dress, the sleeveless dress being positioned over a wearers torso comprising the steps of:

attaching said undergarment to an upper portion of said wearer's torso by a strap;

providing a fastener having first and second ends;

connecting said first end of said fastener to said first end of said clothing item coupling said second end of said fastener to said undergarment strap; and removing said first clothing item from said dress and replacing it with a second clothing item, said first clothing item being, different than said second clothing item.

2. The method of claim 1 wherein said first clothing item has a first design pattern associated therewith.

3. The method of claim 2 wherein said second clothing item has a second design pattern associated therewith said first design pattern being different than said second design pattern.

4. The method of claim 3 wherein said first and second clothing items are sleeves.

* * * * *